United States Patent [19]

Chen

[11] Patent Number: 5,031,803

[45] Date of Patent: Jul. 16, 1991

[54] RECEPTACLE

[75] Inventor: Ying-Che Chen, Taipei, Taiwan

[73] Assignee: Great Truth Co., Ltd., South El Monte, Calif.

[21] Appl. No.: 471,437

[22] Filed: Jan. 29, 1990

[51] Int. Cl.[5] ..... A47G 19/14; A63F 7/02

[52] U.S. Cl. ..... 222/465.1; 40/324; 273/143 R; 446/243; 446/73

[58] Field of Search ..... 206/534, 459, 315.1, 206/579; 215/230; 434/159, 167; 273/142 R, 143 R; 40/306, 308, 310, 324, 327, 334, 335; 446/168, 169, 243, 267, 73; 222/572, 465.1; D21/105, 107, 109, 143; D7/507, 509, 312

[56] References Cited

U.S. PATENT DOCUMENTS

| | | | |
|---|---|---|---|
| 2,844,893 | 3/1953 | Keller | 40/310 |
| 4,713,900 | 12/1987 | Calloway Jr. et al. | 40/324 |
| 4,877,119 | 10/1989 | Hosking | 40/306 |

*Primary Examiner*—Andres Kashnikow
*Assistant Examiner*—Lesley D. Morris
*Attorney, Agent, or Firm*—Ladas & Parry

[57] ABSTRACT

A receptacle for containing and receiving things has a hollow body with a groove on its outer surface. At least one article, which can be moved manually or spontaneously, is movably confined by the groove. The visual movement of the article on the groove provides an amusing effect to the user.

8 Claims, 5 Drawing Sheets

RECEPTACLE

BACKGROUND OF THE INVENTION

This invention relates to a reCeptacle, more particularly to a receptacle which provides an amusing effect.

Conventional receptacles, such as glasses, cups, water canteens or even housings of pens or ballpens, are known to be plain and dull-looking. To make the receptacles more lively and to distinguish one receptacle from another similar receptacle, such receptacles have designs printed on their outer surfaces and sometimes have been given irregular shapes.

SUMMARY OF THE INVENTION

It is therefore a main object of this invention to provide a receptacle which not only has a containing effect, but also provides an amusing effect.

Another object of this invention is to provide a receptacle having an article on its outer surface, the article capable of being moved manually or spontaneously on the outer surface while the receptacle is in use, enabling said receptacle to generate an amusing effect through the visual movement of said article.

Accordingly, a receptacle of this invention comprises a rigid hollow body with a groove on its outer surface, and at least one article which is movably confined by the groove.

When a receptacle of this invention is in use, an article moves along the groove, thus providing an amusing effect.

BRIEF DESCRIPTION OF DRAWINGS

Other features of this invention will become apparent in the following detailed description of the preferred embodiments of this invention with reference to the accompanying drawings, in which.

DETAILED DESCRIPTION OF THE PREFERRED EMBODIMENT

Figure 1:
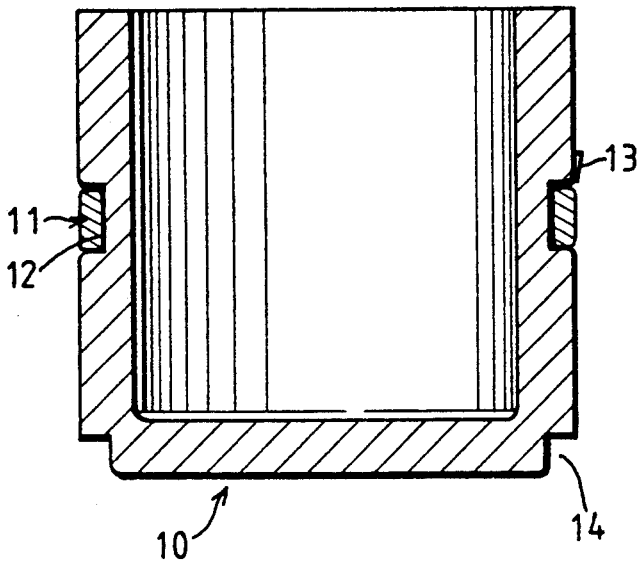
FIG. 1 is a sectional view of a preferred embodiment of a receptacle according to this invention.

Referring to FIG. 1, a sectional view of a preferred embodiment of this invention is shown. The receptacle generally comprises a hollow body 10 which is shaped as a vertical cylinder and made of a rigid material, and an article 11, usually made of a flexible material. The hollow body 10 comprises a groove 12 at its outer surface and an article 11 is slidably joined and detachable from said hollow body 10 at the groove 12. In this figure, the groove 12 is shaped as an endless circular path surrounding the hollow body 10.

Figure 2:
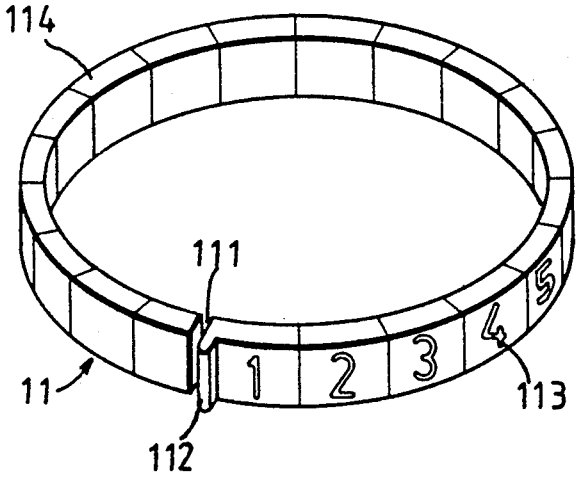
FIG. 2 is a perspective view of a moving article of the receptacle of FIG. 1.
Figure 3:
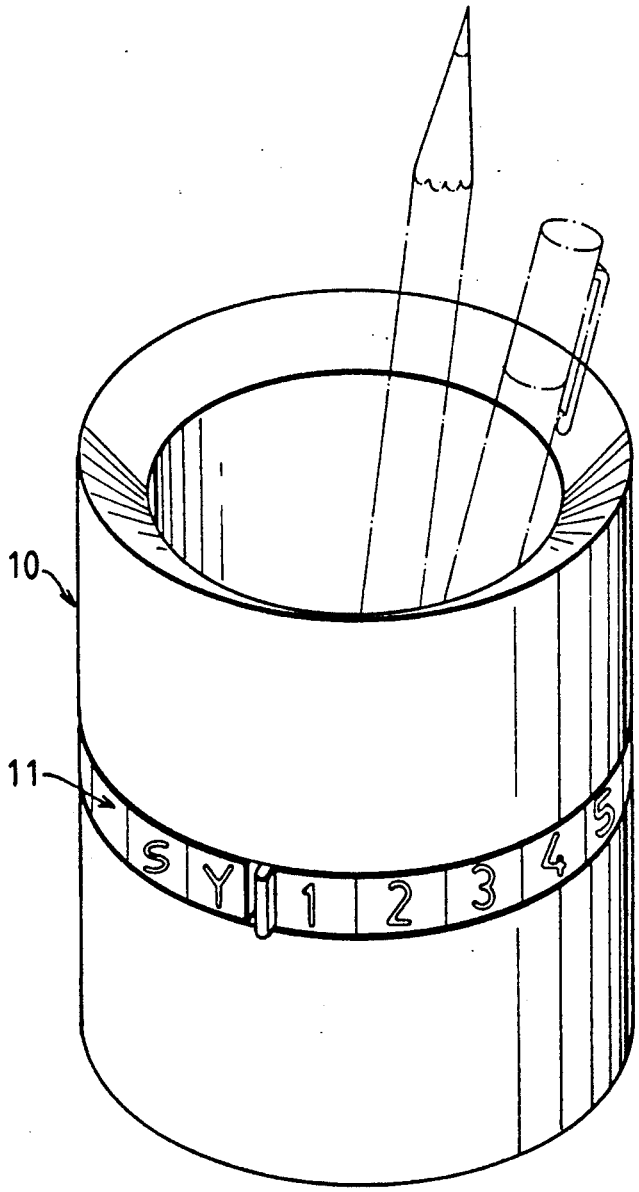
FIG. 3 is a perspective view of a receptacle having an embodiment similar to the receptacle of FIG. 1.

FIG. 2 shows the article 11 shaped as a ring with an opening 111 resulting from a cut in the ring, the opening 111 enabling said article 11 to join the hollow body 10 at the groove 12. The article 11 also comprises a handle 112 outwardly and radially protruding therefrom. The application of a force tangent to the groove 12 at the handle 112 will cause the article 11 to slide along said groove 12. The article 11 may also have different prints 113, such as numbers, on its outer surface. An indicator 13 may be attached to or built into the hollow body 10 with the indicator 13 pointing to a number 113 printed on the outer surface of the article 11. A guessing game could then be played by making the article 11 slide along the groove 12 and guessing what number 113 the indicator 13 will point to when said article 11 stops sliding. The article 11 can be constructed to have flat edges 114 at both the top and bottom and the hollow body 10 can be made to have another groove 14 shaped as an endless circular path along its base, so that said article 11 can be used as a coaster by placing said hollow body 10 on top of the flat edge 114 of said article 11. An example of a receptacle having this embodiment is a pencil holder as shown in FIG. 3.

Figure 4:
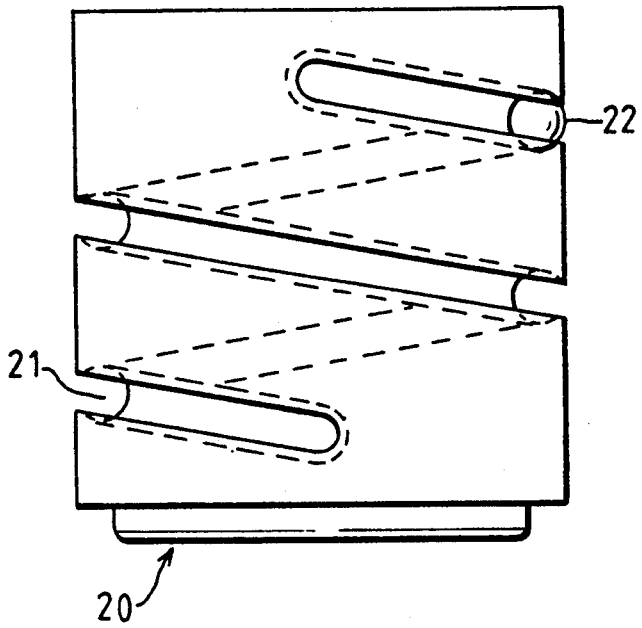
FIG. 4 is a schematic view of a modification of said receptacle of FIG. 1.
Figure 5:
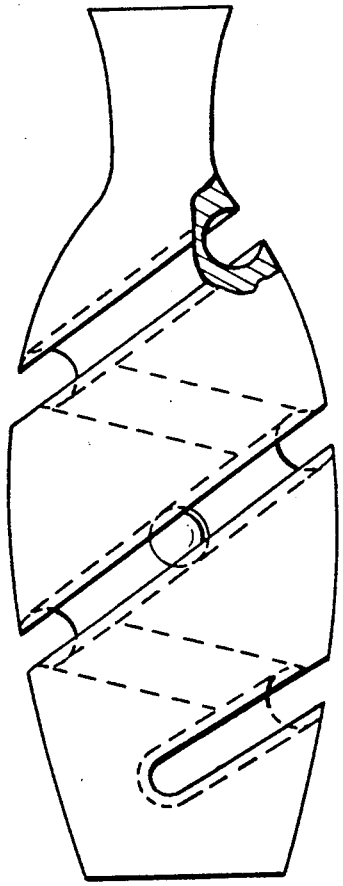
FIG. 5 is a schematic view of a receptacle having an embodiment similar to the receptacle of FIG. 4.

FIG. 4 is a modification of the preferred embodiment of FIG. 1. In this figure, the groove 21 is a spiral path with two ends, said groove 21 surrounding the hollow body 20. At least one article 22, which is a round object and preferably made of metal, is rotatably disposed within the groove 21. The tilting of hollow body 20 will cause the article 22 to move along the groove 21. The article 22 make a clicking sound, due to its metal structure, whenever it impacts the ends of the groove 21. An example of a receptacle having this embodiment is a flower vase as shown in FIG. 5.

Figure 6:
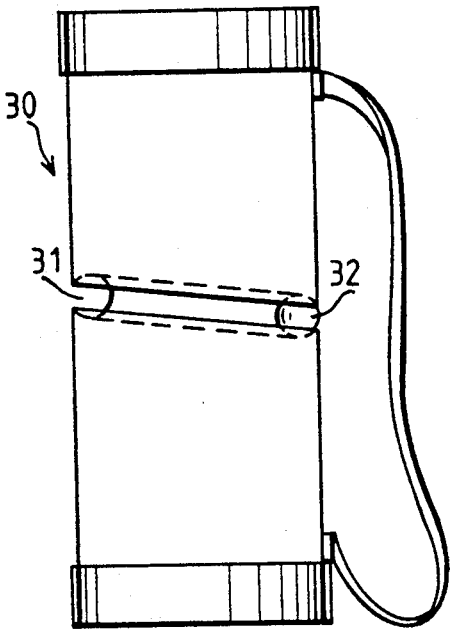
FIG. 6 is a side view of another preferred embodiment of a receptacle of this invention.

FIG. 6 is a side view of a receptacle to be used as a water canteen. Groove 31 makes an endless circular path at the widest portion of hollow body 30. At least one article 32 rotates within the groove 31.

Figure 7:
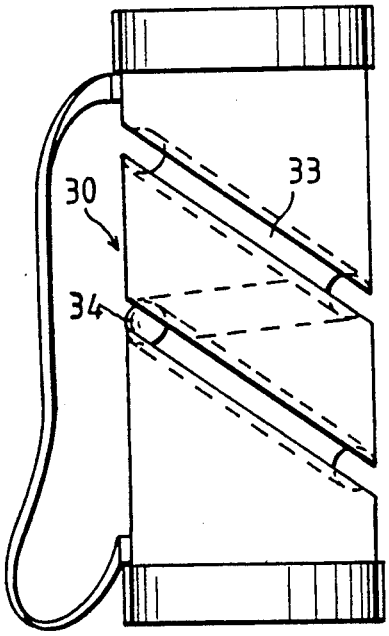
FIG. 7 is a side view of a modification of the receptacle of FIG. 6.

FIG. 7 is a modification of the receptacle of FIG. 6. In this figure, groove 33 is a spiral path extending from top to bottom surrounding hollow body 30. As with FIG. 6, at least one article 34 is inside the groove 33.

Figure 10:
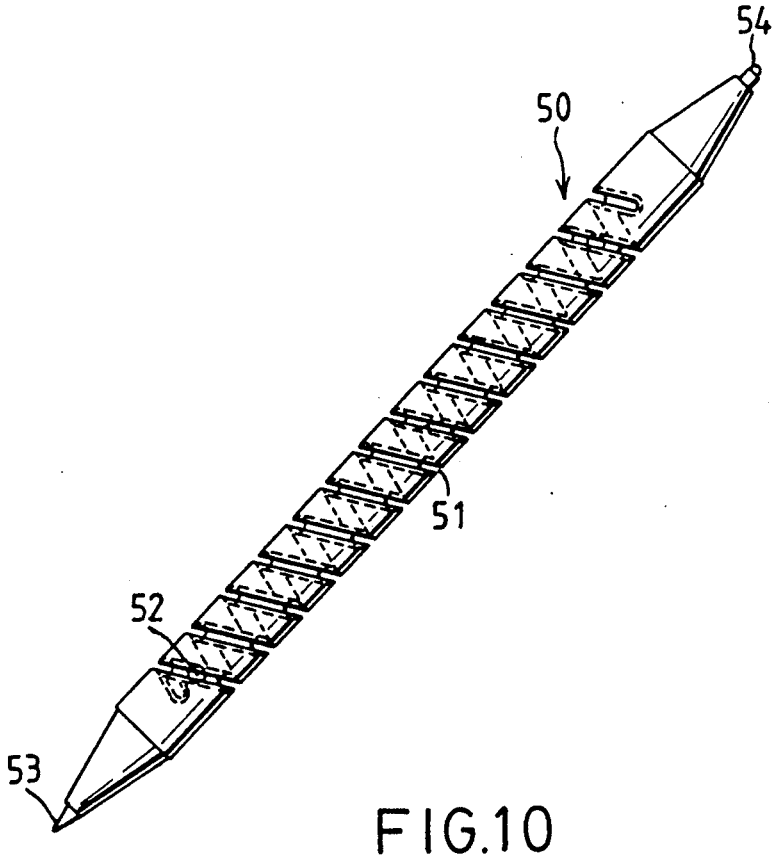
FIG. 10 is a schematic view of yet another preferred embodiment of a receptacle of this invention.
Figure 8:
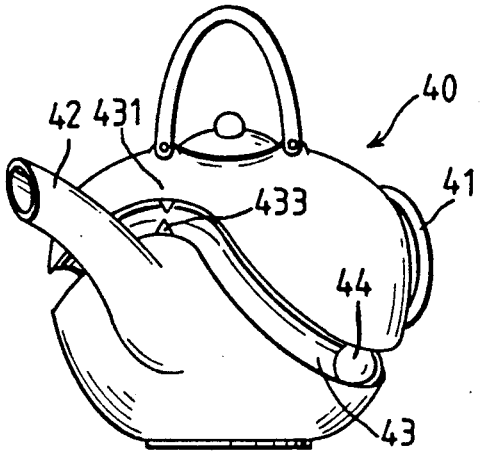
FIG. 8 is a perspective view of still another preferred embodiment of a receptacle of this invention.
Figure 9:
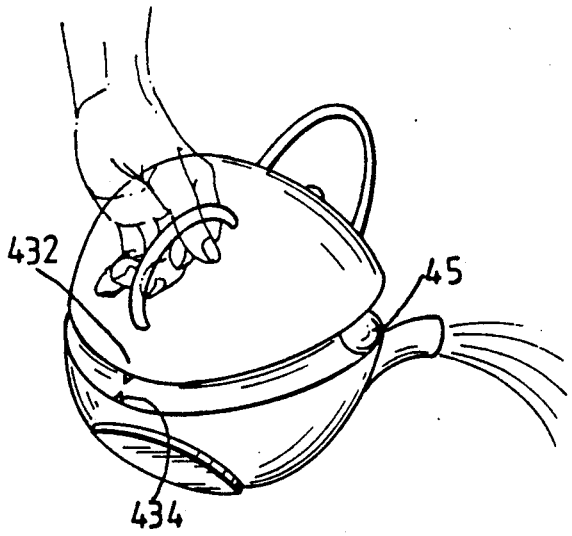
FIG. 9 is a view of the receptacle of FIG. 8 when in use.

FIGS. 8, 9 are perspective views of a receptacle used as a kettle. The kettle 40 comprises a handle 41 attached at its outer surface and an extended spout 42 at the opposite side of the handle 41. Groove 43 is an endless curved groove having a highest portion 431 substantially located near the extended spout 42 and a lowest portion 432 substantially located near the handle 41. Barriers 433 and 434 are located in the two portions respectively, separating groove 43 into two segments, with at least one article 44, 45 disposed in each segment. When liquid is poured out of the kettle 40, as in FIG. 9, articles 44, 45 move from the lowest portion 432 to the highest portion 431, and impact barrier 433, thus making a clicking sound. When the kettle 40 is laid to rest, articles 44, 45 traverse in the opposite direction and make a clicking sound as the articles 44, 45 impact barrier 434. Referring to FIG. 10, still another preferred embodiment of this invention is shown. The receptacle, to be used as a ballpen with two writing tips 53 and 54, comprises a hollow body 50 which is shaped as an elongated cylinder with two ends. Groove 51 is a spiral groove extending from one end of hollow body 51 to the other. When the writing tip in use is changed from tip 53 to tip 54 or vice versa, at least one article 52, also a round object, moves within the groove 51.

While the invention has been described in connection with what is considered the most practical and preferred embodiment, it is understood that the invention is not limited to the disclosed embodiments, but on the contrary is intended to cover various modifications and equivalent arrangements included within the spirit and scope of the broadest interpretation so as to encompass all such modifications and equivalent arrangements.

I claim:

1. A receptacle for containing and receiving things comprising:

a hollow body;

at least two endless circular grooves formed on the outer surface of the body with one of the grooves along the base of the body; and at least one article being movable in either one of said grooves and detachable therefrom and having a flat upper surface on which said body can rest.

2. The receptacle as claimed in claim 1, wherein said article is a ring having two open ends and a handle protruded outwardly therefrom and being made of a flexible material.

3. A receptacle for containing and receiving things comprising:

a hollow body;

at least one curved groove on the outer surface of the body; and at least one rolling article being movable along the groove.

4. The receptacle as claimed in claim 3, wherein said article is made of metal so as to generate a clicking sound due to the impact of said articles when said receptacle is tilted.

5. The receptacle as claimed in claim 4, wherein said body is in shape of a kettle having a handle attached at one side of its outer surface and an extended spout on the opposite side of the body, said groove forming an endless curved path having a highest portion substantially located near the spout and a lowest portion substantially located near the handle.

6. The receptacle as claimed in claim 5, wherein said groove is separated into two segments by barriers formed in both the highest and lowest portions of the groove, and has at least one said article in each of the segments.

7. The receptacle as claimed in claim 3, wherein said body is an elongated cylinder with two ends, and said groove in a spiral manner extends from one end of the cylinder to the other.

8. The receptacle as claimed in claim 7, wherein said body is the housing of a pen, with at least one writing tip protruding from one of the ends.

* * * * *